US011193684B2

(12) United States Patent
Shaffer

(10) Patent No.: US 11,193,684 B2
(45) Date of Patent: Dec. 7, 2021

(54) DETECTING BLOCKAGE OF AIR CONDITIONER UNIT BASED ON CONTROL SIGNAL

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 100 days.

(21) Appl. No.: 16/169,362

(22) Filed: Oct. 24, 2018

(65) Prior Publication Data

US 2020/0132320 A1 Apr. 30, 2020

(51) Int. Cl.
*F24F 11/32* (2018.01)

(52) U.S. Cl.
CPC ..... *F24F 11/32* (2018.01); *F24F 2203/021* (2013.01); *F24F 2221/20* (2013.01); *F24F 2221/34* (2013.01)

(58) Field of Classification Search
CPC .. F24F 11/32; F24F 2203/021; F24F 2221/34; F24F 2221/20; F24F 1/02; F24F 1/027; F24F 1/0284; F24F 1/031; F24F 1/0314; F24F 1/0317; F24F 1/0375; F24F 1/0022; F24F 1/0093; F24F 11/33; F24F 11/49; F24F 11/67; F24F 11/873
See application file for complete search history.

(56) References Cited

U.S. PATENT DOCUMENTS 4,635,445 A * 1/1987 Otsuka ..... F24F 3/0442 62/158
5,131,455 A * 7/1992 Tsuchiyama ..... F24F 1/027 165/240
5,161,739 A * 11/1992 Saito ..... F24D 7/00 237/67
5,440,890 A * 8/1995 Bahel ..... F25B 13/00 62/81

(Continued)

FOREIGN PATENT DOCUMENTS

CN 1306693 C 3/2007
JP H07180879 A 7/1995

(Continued)

OTHER PUBLICATIONS

Pulse Width Modulation Used for Motor Control (Year: 2017).*

*Primary Examiner* — Jianying C Atkisson
*Assistant Examiner* — Jose O Class-Quinones
(74) *Attorney, Agent, or Firm* — Dority & Manning, P.A.

(57) ABSTRACT

Air conditioner units and methods for operating air conditioner units are provided. A method includes determining a benchmark control signal corresponding to a predetermined speed of a fan of the air conditioner unit. The method further includes activating a heating unit of the air conditioner unit. The heating unit includes a plurality of heater banks. The method also includes activating the fan while the heating unit is active and measuring a control signal to the fan after activating the fan. The method further includes comparing the measured control signal to the benchmark control signal, and disabling one of the plurality of heater banks when the measured control signal is less than the benchmark control signal.

20 Claims, 4 Drawing Sheets

(56) References Cited

U.S. PATENT DOCUMENTS

| | | | | |
|---|---|---|---|---|
| 5,477,913 | A * | 12/1995 | Polk | F23N 5/242 165/11.1 |
| 6,729,390 | B1 * | 5/2004 | Toth | F24D 12/02 165/240 |
| 8,374,731 | B1 * | 2/2013 | Sullivan | G05D 23/1934 700/299 |
| 2006/0016201 | A1 * | 1/2006 | Kopel | G01K 13/00 62/129 |
| 2010/0206869 | A1 * | 8/2010 | Nelson | F24H 9/2007 219/494 |
| 2012/0221150 | A1 * | 8/2012 | Arensmeier | F24F 11/30 700/276 |
| 2015/0075766 | A1 * | 3/2015 | Alston | F24F 11/30 165/287 |
| 2016/0061465 | A1 * | 3/2016 | Billman | F24F 1/00 165/121 |
| 2016/0061466 | A1 * | 3/2016 | Billman | F24F 11/77 165/121 |
| 2016/0061467 | A1 * | 3/2016 | Billman | F24F 11/30 62/56 |
| 2018/0031262 | A1 * | 2/2018 | Atchison | F24F 11/65 |

FOREIGN PATENT DOCUMENTS

| | | | |
|---|---|---|---|
| JP | 2985754 | B2 | 12/1999 |
| JP | 3695846 | B2 | 9/2005 |
| JP | 6109545 | B2 | 4/2017 |
| KR | 20050102913 | A | 10/2005 |

* cited by examiner

DETECTING BLOCKAGE OF AIR CONDITIONER UNIT BASED ON CONTROL SIGNAL

FIELD OF THE INVENTION

The present disclosure relates generally to air conditioner units, and more particularly to methods and apparatus for detecting blockage of air conditioner units during heating operations.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

In many currently known air conditioner units, the heating unit is formed from a plurality of heater banks. Each bank may have a different rated power output. The highest output for the unit generally occurs when all heater banks are operating at the same time. Additionally, many currently known air conditioner units have multiple blower fan speed settings. For example, a blower fan may in some cases be operated at a low setting or a high setting, or in some cases at various other intermediate settings.

One concern during operation of air conditioner units is overheating of the unit, particularly if a blockage occurs. For example, a blockage to the air inlet path and/or air outlet path prevents proper airflow from occurring within the unit. Particularly when all heater banks are on and the airflow is low, temperatures within the unit can rise significantly, leading to deformation and/or other damage to components of the unit. Particularly vulnerable components include, for example, plastic components of the heater housing.

Accordingly, improved methods and apparatus for operating air conditioner units are desired. In particular, methods and apparatus that detect blockage of the air conditioner unit would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a method for operating an air conditioner unit is provided. The method includes determining a benchmark control signal corresponding to a predetermined speed of a fan of the air conditioner unit. The method further includes activating a heating unit of the air conditioner unit. The heating unit includes a plurality of heater banks. The method also includes activating the fan while the heating unit is active and measuring a control signal to the fan after activating the fan. The method further includes comparing the measured control signal to the benchmark control signal, and disabling one of the plurality of heater banks when the measured control signal is less than the benchmark control signal.

In accordance with another embodiment, an air conditioner unit is provided. The air conditioner unit includes a blower fan. The blower fan includes a blade assembly and a motor connected to the blade assembly. The air conditioner unit also includes a heating unit. The heating unit includes a plurality of heater banks. The air conditioner unit further includes a power source in electrical communication with the blower fan motor and the plurality of heater banks, and a controller in operable communication with the motor and the plurality of heater banks. The controller is operable for determining a benchmark control signal for a predetermined speed of the blower fan, activating the heating unit, activating the blower fan while the heating unit is active, and measuring a control signal to the blower fan after activating the blower fan. The controller is further operable for comparing the measured control signal to the benchmark control signal and disabling one of the plurality of heater banks when the measured control signal is less than the benchmark control signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
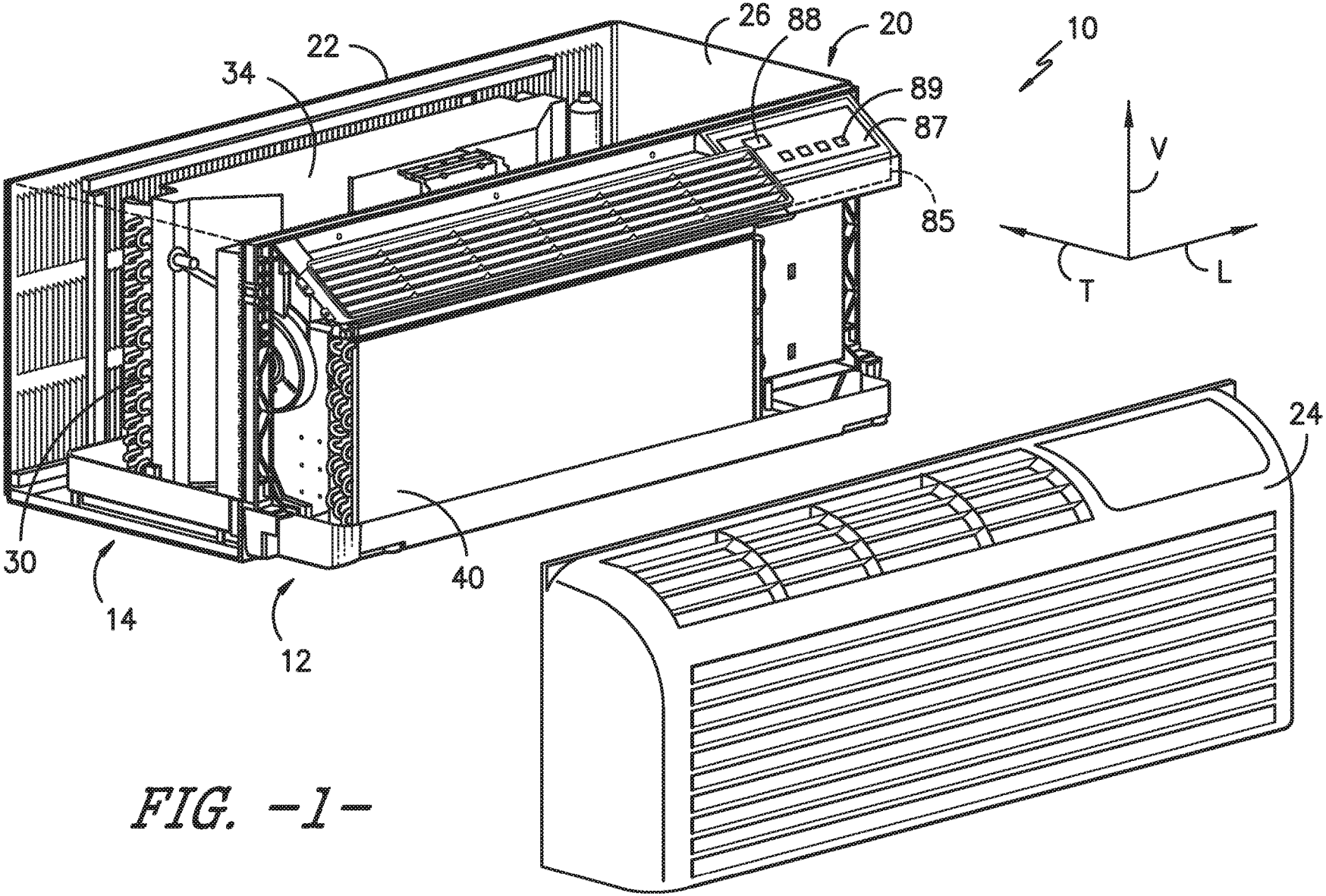
FIG. 1 provides a perspective view of an air conditioner unit, with a room front exploded from a remainder of the air conditioner unit for illustrative purposes, in accordance with one or more embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. The directions V, L, and T are mutually perpendicular to each other, such that an orthogonal coordinate system is generally defined.

A housing 20 of the unit 10 may contain various other components of the unit 10. Housing 20 may include, for example, a rear grill 22 and a wall sleeve 26 which may extend along the transverse direction T from the rear grill 22 towards the indoor portion 12. The rear grill 22 may be part of the outdoor portion 14, while a room front 24 is part of the indoor portion 12. As illustrated for example in FIG. 1, the room front 24 may include a front grille 24 which is mounted on the indoor portion 12 of the air conditioner unit 10. Components of the outdoor portion 14, such as an outdoor heat exchanger 30, outdoor fan (not shown), and compressor (not shown) may be housed within the wall sleeve 26. A shroud or casing 34 may additionally enclose the outdoor fan, as shown.

Figure 2:
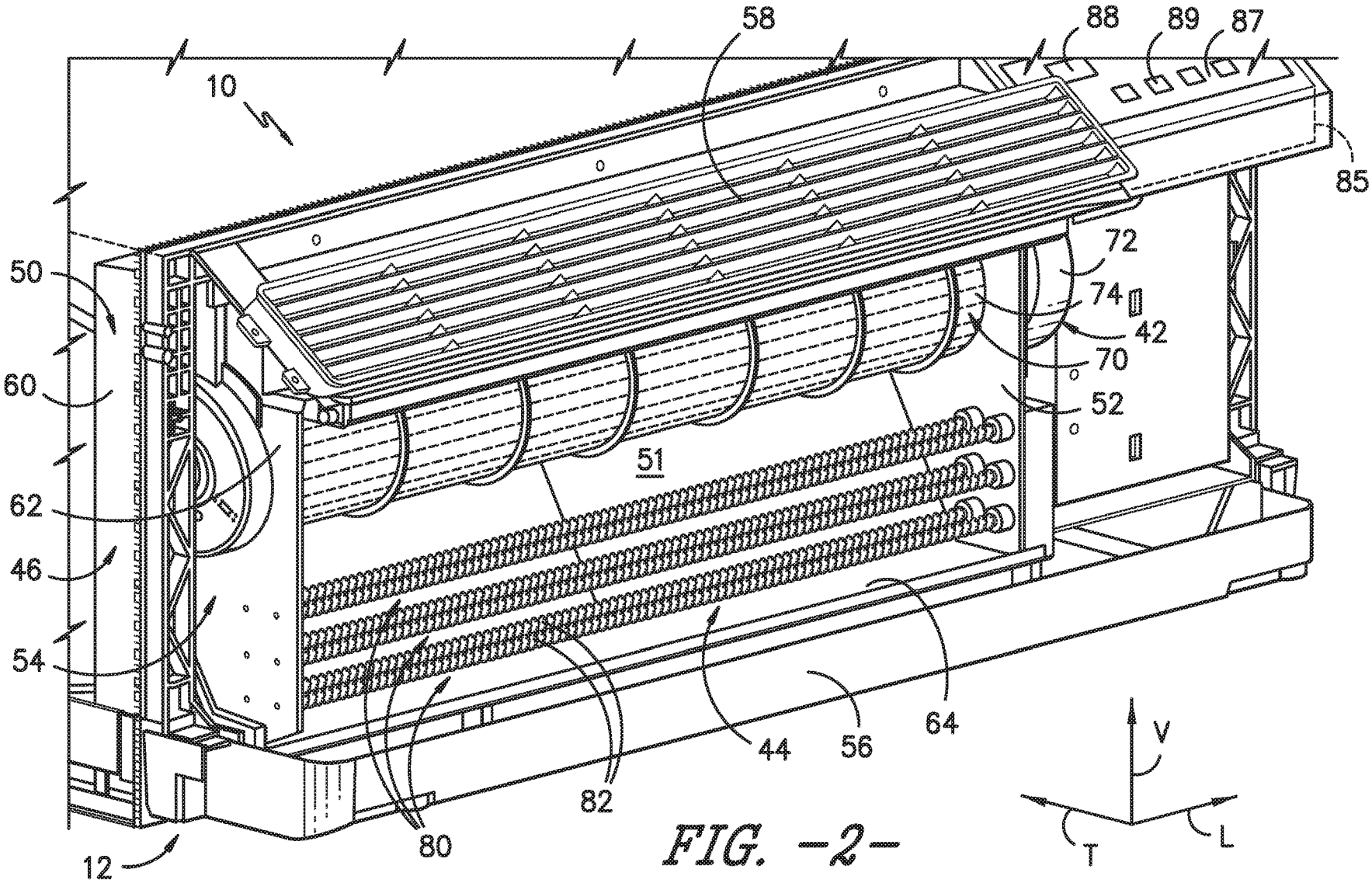
FIG. 2 is a perspective view of components of an indoor portion of an air conditioner unit in accordance with one or more embodiments of the present disclosure.
Figure 3:
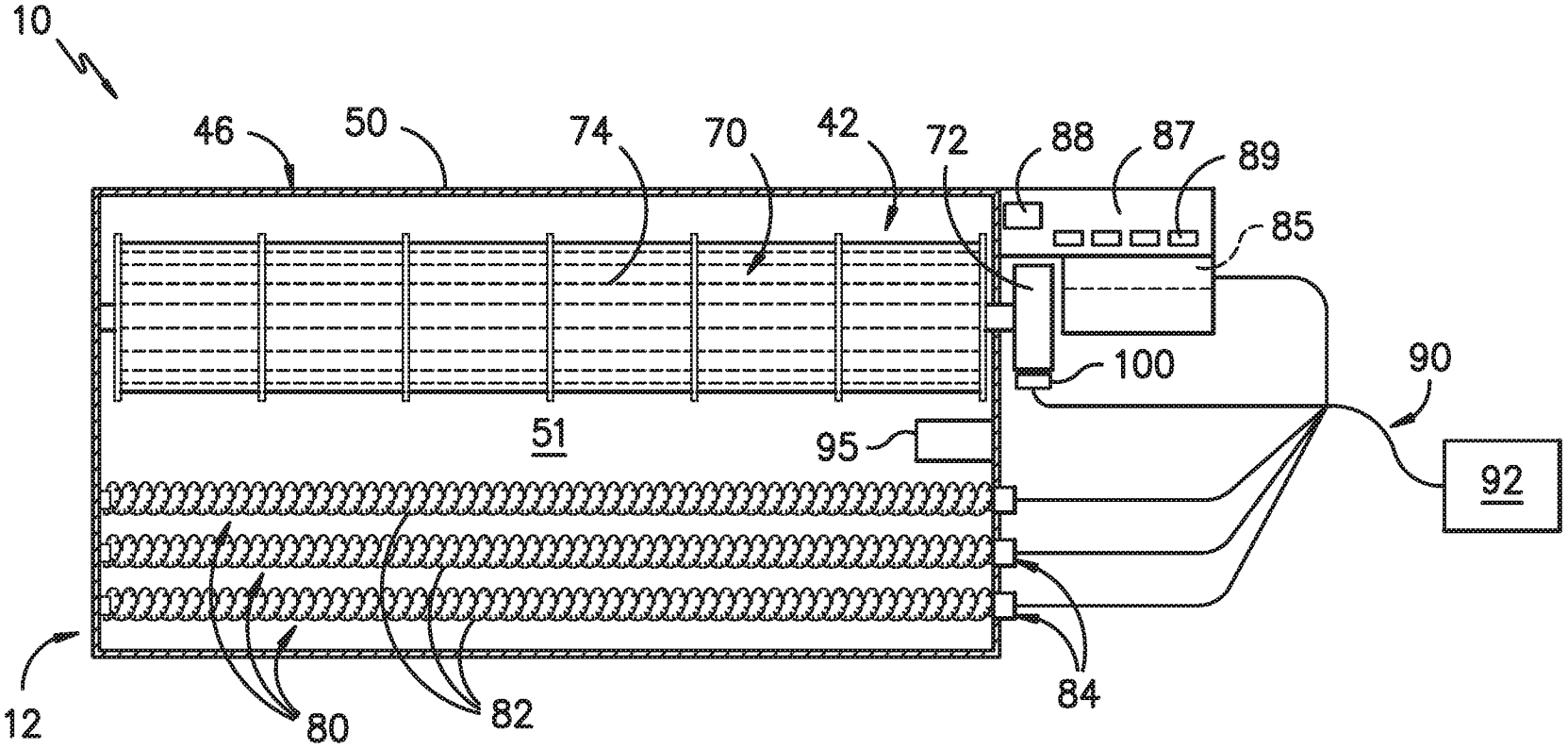
FIG. 3 is a schematic diagram of components of an air conditioner unit in accordance with one or more embodiments of the present disclosure.

Referring now also to FIGS. 2 and 3, indoor portion 12 may include, for example, an indoor heat exchanger 40, a blower fan 42, and a heating unit 44. These components may, for example, be housed behind the room front 24. In at least some embodiments, the unit 10 may also include a reversing valve for reversing a direction of refrigerant flow between the outdoor heat exchanger 30 and the indoor heat exchanger 40 to provide a heat pump operation mode, as is generally understood in the art. Additionally, a heater housing 46 may generally support and/or house various other components or portions of the indoor portion 12, such as the blower fan 42 and the heating unit 44.

Heater housing 46 may have peripheral surfaces 50 that define a housing interior 51. For example, the peripheral surfaces 50 may include a first sidewall 52 and a second sidewall 54 which are spaced apart along the lateral direction L. Peripheral surfaces 50 may additionally include a base pan 56 and an outlet air diverter 58, each of which may extend between the sidewalls 52, 54 along the lateral direction L.

The housing 46 may be formed from one or more components. For example, in exemplary embodiments, the housing 46 may be formed from a bulkhead 60 and a shroud 62. The bulkhead 60 may in some embodiments be formed from a suitable plastic, or alternatively may be formed from any suitable material. In some embodiments, the housing interior 51 may include a separate metallic heater shield that blocks heat from the heater from being directly absorbed by the material, e.g., plastic material, of the bulkhead 60. The shroud 62 may in some embodiments be formed from a suitable metal, or alternatively may be formed from any suitable material. The shroud 62 may be connected to the bulkhead 60, and the bulkhead 60 and shroud 62 may together include the peripheral surfaces 50. For example, base pan 56 and outlet air diverter 58 may be components of the bulkhead 60, and portions of or entire sidewalls 52, 54 may be components of the shroud 62. Shroud 62 may additionally include an interior shroud base 64, which may for example be disposed within interior 51 adjacent base pan 56.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed within the interior 51 of the heater housing 46. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the heater housing 46. Accordingly, the shaft may for example extend through one of the sidewalls 52, 54 to connect the motor 72 and blade assembly 70.

Heating unit 44 in exemplary embodiments includes one or more heater banks 80. Each heater bank 80 may be individually powered, separately from other heater banks 80, to provide heat. In exemplary embodiments, three heater banks 80 may be utilized. Further, each heater bank 80 may in some embodiments have a different rated power level. For example in some embodiments, a heating unit 44 may include a low power heater bank, a medium power heater bank, and a high power heater bank. In some specific embodiment, heating unit 44 include a 1000 Watt bank 80, a 1400 Watt bank 80, and a 2400 Watt bank 80. Each heater bank 80 may further include at least one heater coil or coil pass 82, such as in exemplary embodiments two heater coils or coil passes 82. As shown, in exemplary embodiments multiple heater banks 80 may be stacked vertically, and the coils 82 of a heater bank 80 may be arranged side-by-side. Accordingly, in exemplary embodiments wherein each heater bank 80 has two heater coils 82 the coils 82 may be arranged in two columns and three rows as shown.

The operation of air conditioner unit 10, including blower fan 42, heater banks 80, heating coils 82 thereof, and other suitable components, may be controlled by a processing device such as a controller 85. Controller 85 may be in operable communication with, e.g., operably connected to (via for example a suitable wired or wireless connection) such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example, be a touchscreen or other text-readable display screen, or alternatively may simply be a light that can be activated and deactivated as required to provide an indication of, for example, an event or setting for the unit, such as when one or more of the heater banks 80 is disabled, as described below.

A power source 90 may supply power to the unit 10 generally, and specifically to the controller 85, fan 42 (and motor 72 thereof) and heater banks 80. Power source 90 may generally be any suitable electrical power source, such as a power cable that is connected to the various components of the unit 10. Power source 90 may interact with a power supply 92, such as the electrical grid, via for example a power outlet and suitable wiring as is generally understood. The power source 90 may thus generally provide the electrical communication between the power supply 92 and the unit 10 generally and components thereof.

Unit 10 may additionally include a temperature sensor 95, which may be disposed within the interior 51 of housing 46 to measure, for example, temperatures during a heating mode when the heating unit 44 generally is active and/or temperature during a cooling mode. Sensor 95 may be in communication with the controller 85, and may provide such temperature readings to the controller 85.

As discussed, improved methods and apparatus for detecting blockage of air conditioner units 10 during operation thereof would be advantageous. Accordingly, the present disclosure is further directed to methods for operating air conditioner units 10. It should further be understood that, in exemplary embodiments, a controller 85 in accordance with the present disclosure may be operable to perform the various methods steps as disclosed herein. Controller 85 may advantageously be in communication with, for example, the motor 72 and the heater banks 80 to facilitate such operation.

Figure 4:
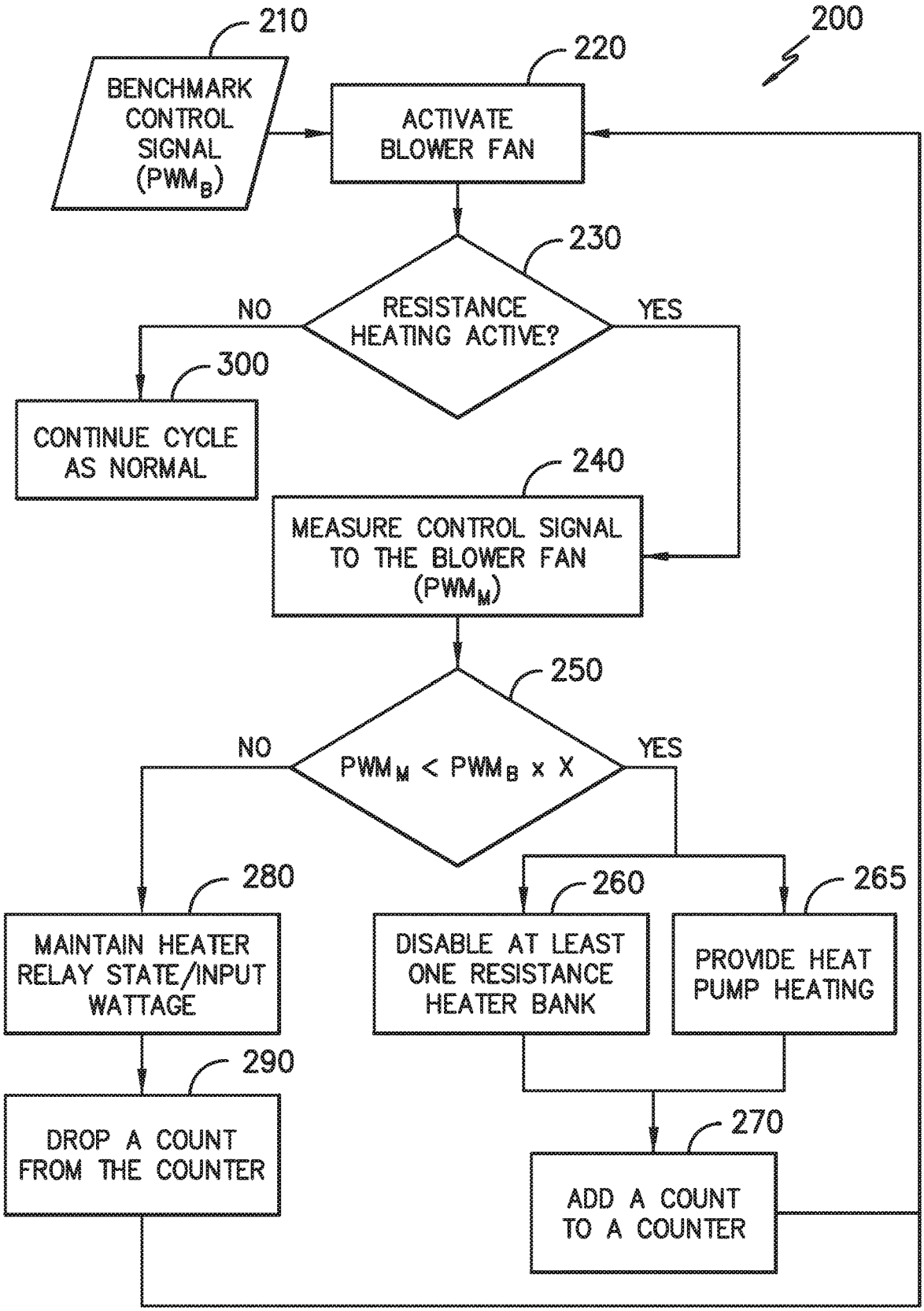
FIG. 4 is a flow chart illustrating steps of a method in accordance with one or more embodiments of the present disclosure.

Turning now to FIG. 4, a method 200 of operating an air conditioner unit may thus include, for example, the step 210 of determining a benchmark control signal ($PWM_B$) corresponding to a predetermined speed of the fan 42 of the air conditioner unit 10. The control signal may be, for example, a pulse width modulation signal. Blower fan 42 may be operable at a variety of speeds, such as a low speed, one or more optional intermediate speeds, and a high speed. For example, user-selectable speed settings (selected via the control panel 87, as discussed above) may include a low speed setting or a high speed setting or, optionally, one or more intermediate speed settings. The predetermined speed may correspond any one or more, up to and including all, of the speed settings. Step 210 may be performed, for example, in a factory setting, and the resulting value(s) for $PWM_B$ may be stored in the memory of the controller 85 before the air conditioner unit 10 is installed. Step 210 may also or instead be performed during initial setup of the air conditioner unit 10 after installation, and/or during maintenance of the air conditioner unit 10 after installation. Thus, the benchmark control signal $PWM_B$ may be measured under controlled conditions, e.g., in the factory or during maintenance, and the step 210 of determining the benchmark control signal $PWM_B$ may include retrieving the value of $PWM_B$ from the memory of the controller 85.

The method 200 may also include a step 220 of activating the blower fan 42. For example, the blower fan 42 may be activated at step 220 by providing a control signal to the blower fan 42, e.g., to the motor 72 thereof. Such control signal may, for example, be a pulse width modulation (PWM) signal. As is generally understood by those of skill in the art, the PWM signal may generally correspond to the speed of the blower fan 42. For example, when airflow through the air conditioner unit 10 is impeded or blocked, the blower fan 42 may essentially spin freely while moving little or no air, e.g., less air than would be moved by the blower fan 42 when the airflow through the air conditioner unit 10 is unimpeded. Accordingly, when the airflow is blocked the blower fan does 42 does less work, e.g., moves less air than in the unimpeded airflow state, and the PWM signal may correspondingly decrease.

After activating the blower fan 42 at step 220, the method 200 may then determine whether a resistance heating unit of the air conditioner unit 10 is active. For example, as mentioned above, the heating unit 44 may include a plurality of heater banks 80. When resistance heating is not active, the method 200 may determine that blockage detection is not required, e.g., the method may include a step 300 of continuing normal operation after activating the blower fan 42 at step 22 when the resistance heating is not determined to be active at step 230, with no further action taken with respect to presently disclosed methods. The continuation of normal operation in accordance with the present disclosure is generally continuance of operation of the unit 10 in accordance with the present settings, with no adjustments in accordance with the present method. When resistance heating is active at step 230, e.g., when one or more of the heater banks 80 of the heating unit 44 is active at step 230, the method 200 may include additional steps to determine whether a blockage may be present, and steps to mitigate or respond to such blockage, if any.

Method 200 may thus further include, for example, the step 240 of measuring a control signal ($PWM_M$) to the fan 42 after activating the fan 42 while the heating unit 44 is active. The measured control signal may also be, for example, a pulse width modulation signal. The control signal may be measured following a delay, for example about five second to about ten seconds, in order to allow the fan 42 to reach a steady-state speed. The measured control signal $PWM_M$ may then be compared to the benchmark control signal $PWM_B$ at step 250. For example, step 250 may include determining whether $PWM_M$ is less than $PWM_B$, such as less than $PWM_B$ by at least about three-quarters of a percent (0.75%). Thus, step 250 may include comparing $PWM_M$ to $PWM_B$ multiplied by an offset factor, e.g., "X" in step 250 of FIG. 4. Thus, X may be about 0.9925, such that step 250 comprises determining whether $PWM_M$ is less than $PWM_B$ by at least 0.75%. In various embodiments, X may be between about 0.90 or ninety percent (90%) and about 0.999 or ninety-nine and nine-tenths percent (99.9%), such as between about 0.992 and about 0.994. Accordingly, various embodiments of the method 200, and in particular the step 250, may include determining whether the PWM signal decreases by at least between about one-half percent (0.5%) and about three-quarters percent (0.75%), or more, up to and including a decrease of at least about ten percent (10%), from the benchmark control signal $PWM_B$ determined at step 210. Such decrease in the PWM signal may indicate a blockage of airflow through the air conditioner unit 10.

When a blockage is detected, e.g., when the determination at step 250 is positive, the method 200 may include, for example, a step 260 of disabling one of the plurality of heater banks 80. In some embodiments, such step 260 may only occur when the measured control signal $PWM_M$ is less than the benchmark control signal $PWM_B$, such as when $PWM_M$ is less than $PWM_B$ by at least a threshold amount, and the threshold amount may be at least 0.5%, such as about 0.667%, such as about 0.75%. In some embodiments, more than one of the heater banks 80 may be disabled at step 260. For example, in embodiments having more than one heater bank 80, all but one heater bank 80 may be disabled. As mentioned above, in some embodiments, three heater banks 80 may be provided, each with a different power, such as a low power heater bank, a medium power heater bank, and a high power heater bank. In such embodiments, the medium power heater bank and the high power heater bank may be disabled at step 260 such that the air conditioner unit 10 operates at a low power level, such as about 1000 Watts.

Method 200 may also include, optionally, a step 265 of providing heat pump heating (e.g., by actuating a reversing valve as described above) as a supplement to the resistance heating. Step 260 may include various combinations of disabling the medium power heater bank and/or the high power heater bank while activating only the low power heater bank and/or medium power heater bank. Additionally or alternatively, method 200 may include providing heat pump heating at step 265. For example, all of the heater banks 80 may be disabled at step 260 and only heat pump heating may be provided when a blockage is detected, or the heat pump heating may be provided in combination with resistance heating when less than all of the heater banks 80 are disabled at step 260.

Method 200 may also include a step 270 of adding a count to a counter. In some embodiments, the method 200 may include notifying a user or operator of a persistent blockage when the counter reaches a predetermined value, such as about ten.

When the determination at step 250 is negative, the method 200 may include a step 280 of maintaining a heater relay state and/or input wattage, e.g., continuing to provide power to each of the one or more heater banks 80 which was activated at step 220. Step 280 may thus include continuing normal operation of the air conditioner unit 10. The continuation of normal operation in accordance with the present disclosure is generally continuance of operation of the unit 10 in accordance with the present settings, e.g., user-selected setting such as a high heat setting, with no adjustments in accordance with the present method. In at least some embodiments, method 200 may further include dropping a count from the counter at step 290 when the measured control signal $PWM_M$ is not less than the benchmark control signal $PWM_B$ and/or not less than $PWM_B$ multiplied by the offset factor X.

The method 200 thus completes the current operation cycle according to one of the steps 260 and 280, and further returns to step 220 at initiation of a subsequent operation cycle of the air conditioner unit 10. That is, after continuing normal operation at step 280, or, in other cases, after the reduced heating operation, e.g., at about 1000 Watts, at step 260 for the remaining duration of the current operation cycle, the method 200 may include a subsequent cycle by returning to step 220 and/or step 210. Thereafter, the subsequent cycle may include reiterating steps 230, 240, and 250, and the method 200 may continue through to either adding or dropping a count from the counter based on the determination at step 250 for the subsequent cycle, until the counter either reaches the predetermined amount, e.g., ten, and an alert is issued, or the counter is reduced to zero.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an air conditioner unit, the method comprising:

measuring a benchmark pulse width modulation control signal corresponding to a predetermined speed of a fan of the air conditioner unit in a factory setting;

storing the benchmark pulse width modulation control signal measured in the factory setting corresponding to the predetermined speed of the fan in a memory of the air conditioner unit;

activating a heating unit of the air conditioner unit, the heating unit comprising a plurality of heater banks;

activating the fan while the heating unit is active;

measuring a pulse width modulation control signal to the fan after activating the fan;

comparing the measured pulse width modulation control signal to the benchmark pulse width modulation control signal; and disabling one of the plurality of heater banks when the measured pulse width modulation control signal is less than the benchmark pulse width modulation control signal.

2. The method of claim 1, wherein the step of disabling one of the plurality of heater banks comprises disabling all of the plurality of heater banks, further comprising providing heat pump heating when the measured pulse width modulation control signal is less than the benchmark pulse width modulation control signal.

3. The method of claim 1, wherein the step of measuring the pulse width modulation control signal comprises measuring the pulse width modulation control signal to the fan following a delay after activating the fan.

4. The method of claim 1, wherein the step of disabling one of the plurality of heater banks comprises disabling one of the plurality of heater banks when the measured pulse width modulation control signal is less than the benchmark pulse width modulation control signal by at least three-quarters of a percent.

5. The method of claim 1, further comprising adding a count to a counter when the measured pulse width modulation control signal is less than the benchmark pulse width modulation control signal.

6. The method of claim 5, further comprising transmitting an alert when the counter reaches ten.

7. The method of claim 5, further comprising removing a count from the counter when the measured control signal is greater than the benchmark control signal.

8. The method of claim 1, wherein the plurality of heater banks comprises a low power heater bank, a medium power heater bank, and a high power heater bank.

9. The method of claim 8, wherein the step of disabling one of the plurality of heater banks comprises disabling the high power heater bank and the medium power heater bank when the measured control signal is less than the benchmark control signal.

10. The method of claim 1, wherein measuring the benchmark pulse width modulation control signal comprises measuring the benchmark pulse width modulation control signal while operating the fan of the air conditioner unit at the predetermined speed in the factory setting.

11. An air conditioner unit comprising:

a blower fan, the blower fan comprising a blade assembly and a motor connected to the blade assembly;

a heating unit, the heating unit comprising a plurality of heater banks;

a power source in electrical communication with the blower fan motor and the plurality of heater banks; and a controller in operable communication with the motor and the plurality of heater banks, the controller operable for:

measuring a benchmark pulse width modulation control signal for a predetermined speed of the blower fan in a factory setting;

storing the benchmark pulse width modulation control signal measured in the factory setting for the predetermined speed of the blower fan in a memory of the controller;

activating the heating unit;

activating the blower fan while the heating unit is active;

measuring a pulse width modulation control signal to the blower fan after activating the blower fan;

comparing the measured pulse width modulation control signal to the benchmark pulse width modulation control signal; and disabling one of the plurality of heater banks when the measured pulse width modulation control signal is less than the benchmark pulse width modulation control signal.

12. The air conditioner unit of claim 11, further comprising a reversing valve, the controller operable for disabling all of the plurality of heater banks and actuating the reversing valve, whereby the air conditioner unit provides heat pump heating, when the measured pulse width modulation control signal is less than the benchmark pulse width modulation control signal.

13. The air conditioner unit of claim 11, wherein the step of measuring the pulse width modulation control signal comprises measuring the pulse width modulation control signal to the fan following a delay after activating the blower fan.

14. The air conditioner unit of claim 11, wherein the step of disabling one of the plurality of heater banks comprises disabling one of the plurality of heater banks when the measured pulse width modulation control signal is less than the benchmark pulse width modulation control signal by at least three-quarters of a percent.

15. The air conditioner unit of claim 11, wherein the controller is further operable for adding a count to a counter when the measured pulse width modulation control signal is less than the benchmark pulse width modulation control signal.

16. The air conditioner unit of claim 15, wherein the controller is further operable for transmitting an alert when the counter reaches ten.

17. The air conditioner unit of claim 15, wherein the controller is further operable for removing a count from the counter when the measured pulse width modulation control signal is greater than the benchmark pulse width modulation control signal.

18. The air conditioner unit of claim 11, wherein the plurality of heater banks comprises a low power heater bank, a medium power heater bank, and a high power heater bank.

19. The air conditioner unit of claim 18, wherein the step of disabling one of the plurality of heater banks comprises disabling the high power heater bank and the medium power heater bank when the measured pulse width modulation control signal is less than the benchmark pulse width modulation control signal.

20. The air conditioner unit of claim 11, wherein the controller is operable for measuring the benchmark pulse width modulation control signal while operating the fan of the air conditioner unit at the predetermined speed in the factory setting.

* * * * *